US008894182B2

(12) United States Patent
Osaki et al.

(10) Patent No.: US 8,894,182 B2
(45) Date of Patent: Nov. 25, 2014

(54) LIQUID DISCHARGE HEAD

(75) Inventors: Yasuhiko Osaki, Yokohama (JP); Toshiaki Hirosawa, Hiratsuka (JP); Hiroki Tajima, Yokohama (JP); Akira Yamamoto, Yokohama (JP); Kyota Miyazaki, Tama (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 13/103,770

(22) Filed: May 9, 2011

(65) Prior Publication Data

US 2011/0279545 A1 Nov. 17, 2011

(30) Foreign Application Priority Data

May 14, 2010 (JP) ..... 2010-112365

(51) Int. Cl.
*B41J 2/135* (2006.01)
*B41J 2/14* (2006.01)
*B41J 2/16* (2006.01)

(52) U.S. Cl.
CPC ..... *B41J 2/1404* (2013.01); *B41J 2/14145* (2013.01); *B41J 2/1408* (2013.01)
USPC ..... 347/44; 347/48; 347/49

(58) Field of Classification Search
CPC ..... B41J 2/1408; B41J 2/3358; B41J 29/377; B41J 2202/08
USPC ..... 347/44, 65
See application file for complete search history.

(56) References Cited

U.S. PATENT DOCUMENTS

| | | | | |
|---|---|---|---|---|
| 5,459,498 | A * | 10/1995 | Seccombe et al. | 347/18 |
| 6,322,206 | B1 | 11/2001 | Boyd et al. | |
| 6,607,259 | B2 * | 8/2003 | Mott et al. | 347/18 |
| 7,204,578 | B2 * | 4/2007 | Harvey et al. | 347/40 |
| 2009/0051724 | A1 * | 2/2009 | Katoh | 347/18 |
| 2009/0141062 | A1 * | 6/2009 | Takano et al. | 347/18 |
| 2009/0141064 | A1 * | 6/2009 | Shihoh et al. | 347/18 |

FOREIGN PATENT DOCUMENTS

| | | | |
|---|---|---|---|
| JP | 07-096612 | A | 4/1995 |
| JP | 11-198403 | A | 7/1999 |
| JP | 2005-502499 | A | 1/2005 |
| JP | 2009-137023 | A | 6/2009 |

* cited by examiner

*Primary Examiner* — Matthew Luu
*Assistant Examiner* — Renee I Wilson
(74) *Attorney, Agent, or Firm* — Canon USA Inc. IP Division

(57) ABSTRACT

A liquid discharge head includes a liquid discharge substrate having a discharge port array, and a channel member having a mounted face on which the liquid discharge substrate is mounted, channels for supplying liquid to the discharge port array, and a low thermal conductivity portion, wherein the channels includes an opening for flowing liquid, which is provided at a part except for both ends of the discharge port array, a first channel for passing the liquid, and a second channel for passing the liquid in a direction opposite to the liquid flowing direction in the first channel, wherein the opening, the first channel, the low thermal conductivity portion, and the second channel are provided in this order to be vertical to the mounted face, and the opening and the low thermal conductivity portion are provided to be at least partially overlapped one above the other.

9 Claims, 16 Drawing Sheets

LIQUID DISCHARGE HEAD

BACKGROUND OF THE INVENTION

1. Field of the Invention

The present invention relates to a liquid discharge head configured to discharge a liquid.

2. Description of the Related Art

An ink jet head representative for a liquid discharge head configured to discharge a liquid can perform faster recording as the length of a discharge port array is longer. In the discharge port array, a plurality of discharge ports configured to discharge ink is arranged. For improving the recording speed, there has recently been required a full-line ink jet head having a length of discharge port array capable of recording a recording medium with more than the width of about 4 to 12 inches.

The liquid discharge head discussed in U.S. Pat. No. 6,322,206 is configured such that a plurality of liquid discharge substrates is arranged on a channel member in which channels are formed by laminating layers having openings as illustrated in FIG. 5 of U.S. Pat. No. 6,322,206. With the structure, it is possible to provide an ink jet head having a large recording width.

The liquid discharge head discussed in U.S. Pat. No. 6,322,206 is configured such that an ink inlet port and an ink outlet port are formed at both ends of the channel member in the longitudinal direction and ink is circulated inside the channels as illustrated in FIGS. 7A, 7B, and 10 of U.S. Pat. No. 6,322,206.

To cool the liquid discharge head or the like, a main channel configured to supply liquid to the liquid discharge substrates may be provided in the channel member in the direction in which the discharge ports are arranged. Since the liquid flows inside the main channel while being heated due to heat radiated from the liquid discharge substrates generated along with the discharging of the liquid, the effect of the cooling by the liquid decreases toward the downstream of the liquid flow in the main channel. As a result, the temperature of the liquid discharge substrates increases toward the downstream of the main channel.

In U.S. Pat. No. 6,322,206, an inlet port through which liquid flows, which is provided in the channel member, is provided at an end of the channel member in the longitudinal direction. However, the inlet port may be provided above the mounted face of the channel member on which the liquid discharge substrates are mounted in the vertical direction in the middle of the main channel in the liquid flowing direction. In this case, to flow the liquid from the end of the main channel in the longitudinal direction of the channel member, there may be a method that a sub-channel configured to connect the inlet port and the main channel is provided above the main channel in the channel member.

In the channel member having such a structure, the temperature of the liquid flowing through the inlet port or sub-channel is lower than the temperature of the liquid flowing through the main channel. Since the amount of liquid flowing inside the main channel decreases toward the downstream of the main channel along with the discharging of the liquid, the amount of liquid flowing through the inlet port or the sub-channel is more than the amount of liquid flowing through the main channel except for the upstream end of the main channel.

Therefore, the temperature of part of the liquid discharge substrates positioned below the mounted face of the channel member in the vertical direction in the inlet port or the sub-channel may decrease due to the effect of the cooling by the liquid in the inlet port or sub-channel. Thus, largely-affected parts and small-affected parts by the effect of the cooling of the liquid flowing through the inlet port or the sub-channel may approach each other in the liquid discharge substrates. Thus, there occurs a difference in the amount of discharged liquid due to a temperature difference of the liquid discharged in the adjacent discharge ports, which can be recognized as a difference in density on an image.

SUMMARY OF THE INVENTION

The present invention is directed to a liquid discharge head capable of solving an issue caused by a position where an inlet port or a sub-channel is provided, that is, suppressing a degradation in image quality due to a temperature difference of a liquid in adjacent discharge ports.

According to an aspect of the present invention, a liquid discharge head includes a liquid discharge substrate having a discharge port array in which a plurality of discharge ports configured to discharge liquid are arranged, and a plurality of thermoelectric conversion elements configured to generate energy for discharging liquid from the plurality of discharge ports, and a channel member having a mounted face on which the liquid discharge substrate is mounted, channels configured to supply a liquid to the plurality of discharge ports, and a low thermal conductivity portion having a lower thermal conductivity than a wall forming the channel, wherein the channels includes an opening configured to flow a liquid, which is provided at a part except for both ends of the discharge port array in an arrangement direction in which the plurality of discharge ports is arranged on the backside of the mounted face, a first channel configured to pass the liquid flowed from the opening, which is provided along the arrangement direction, and a second channel configured to pass the liquid flowing through the first channel in a direction opposite to the liquid flowing direction in the first channel, which is provided along the arrangement direction, wherein the opening, the first channel, the low thermal conductivity portion, and the second channel are provided in this order to be vertical to the mounted face, and the opening and the low thermal conductivity portion are provided to be at least partially overlapped one above the other in the vertical direction to the mounted face.

According to another aspect of the present invention, a liquid discharge head includes a liquid discharge substrate having a discharge port array in which a plurality of discharge ports configured to discharge liquid is arranged, and a plurality of thermoelectric conversion elements configured to generate energy for discharging liquid from the plurality of discharge ports, and a channel member having a mounted face on which the liquid discharge substrate is mounted, channels configured to supply liquid to the plurality of discharge ports, and a low thermal conductivity portion having a lower thermal conductivity than a wall forming the channel, wherein the channels includes an opening configured to flow a liquid, a first channel configured to pass the liquid flowed from the opening, which is provided along an arrangement direction in which the plurality of discharge ports is arranged, and a second channel configured to pass the liquid flowing in the first channel in a direction opposite to the liquid flowing direction in the first channel, which is provided along the arrangement direction, wherein the first channel, the low thermal conductivity portion, and the second channel are provided in this order in a direction vertical to the mounted face, and wherein the first channel has a portion overlapped on an area except for both ends of the discharge port array in the vertical direction to the mounted face, and the most upstream part in the flowing direction among the overlapping portions and the low thermal conductivity portion are provided to be at least partially overlapped one above the other in the vertical direction to the mounted face.

According to the present invention, it is possible to prevent a partial decrease in temperature of liquid discharge substrates and to suppress degradation in image quality due to a temperature difference of a liquid in adjacent discharge ports by reducing, by a low thermal conductivity portion, an impact of the cooling on the liquid discharge ports with liquid flowing through the inlet port or the sub-channel.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

(Liquid Discharge Head)

Figure 1:
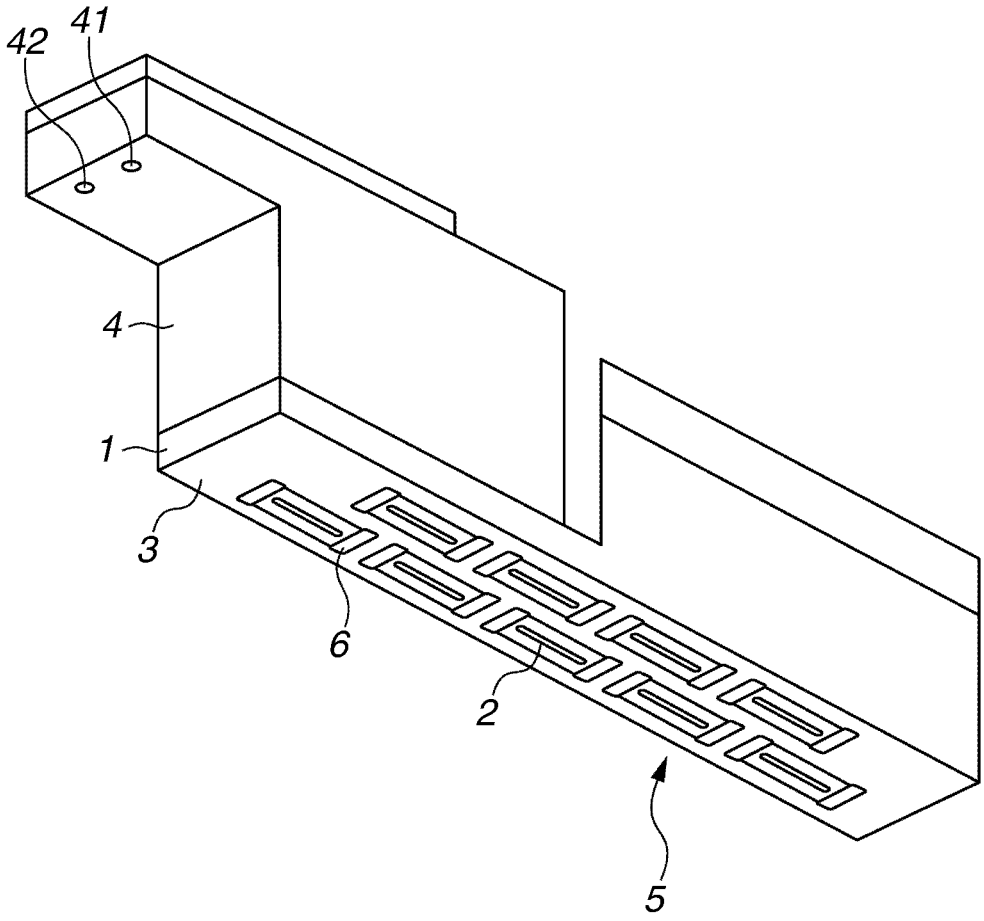
FIG. 1 is an external perspective view illustrating a liquid discharge head according to a first exemplary embodiment of the present invention.
Figure 2:
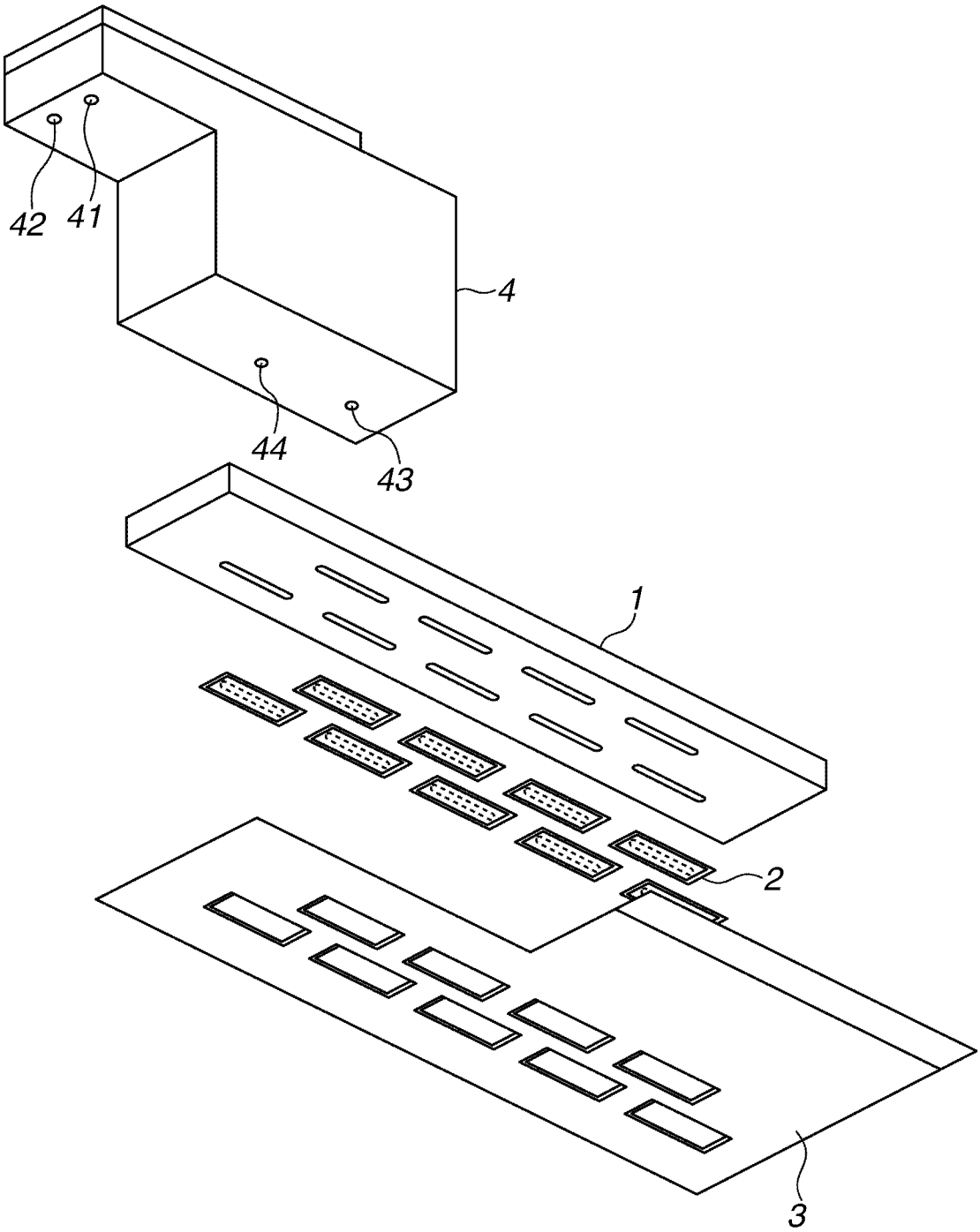
FIG. 2 is an exploded perspective view illustrating the liquid discharge head according to the first exemplary embodiment of the present invention.
Figure 3A:
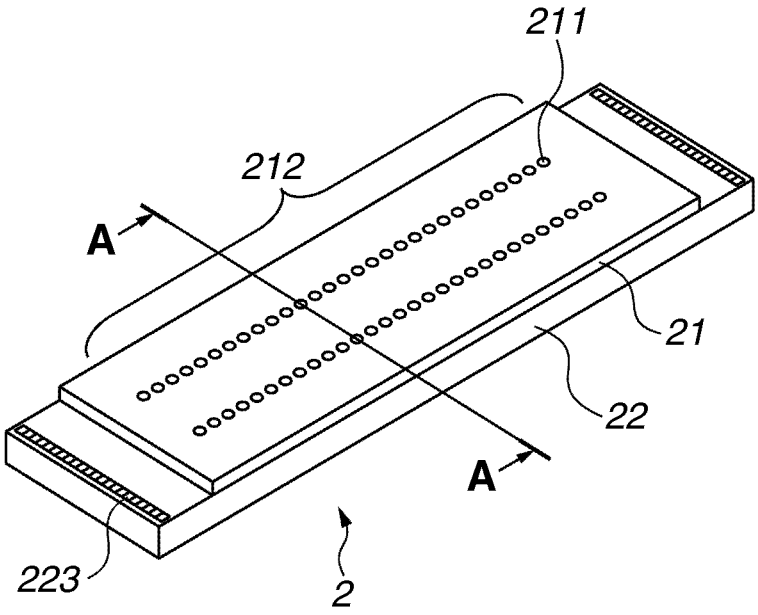
FIGS. 3A and 3B are diagrams illustrating a liquid discharge substrate according to the first exemplary embodiment.
Figure 3B:
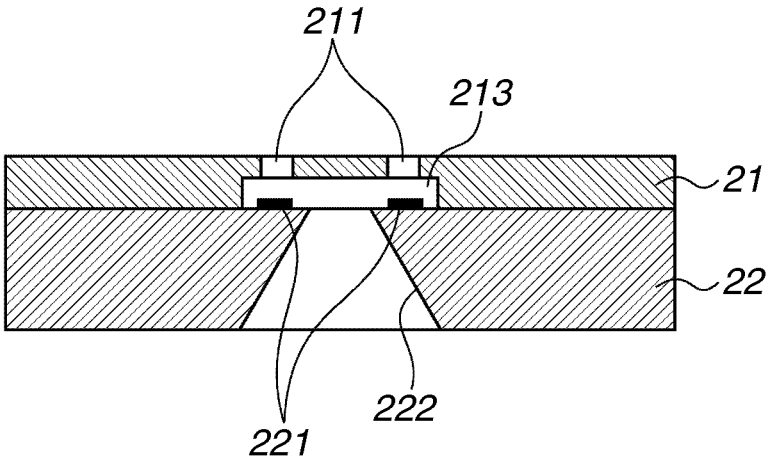
Figure 4A:
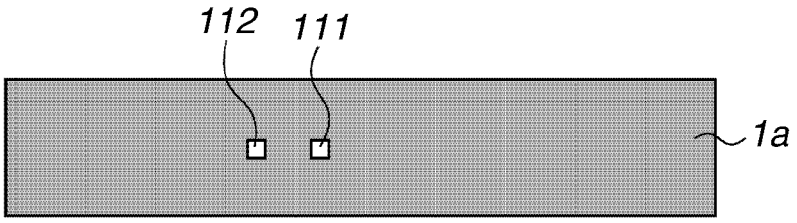
FIGS. 4A to 4G are top views of the respective layers of a channel member according to the first exemplary embodiment.
Figure 4B:
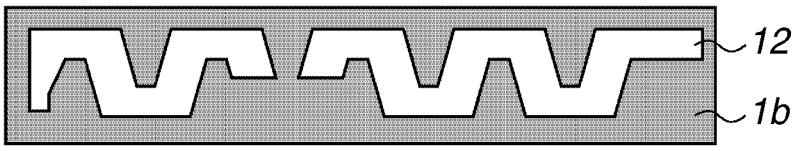
Figure 4C:
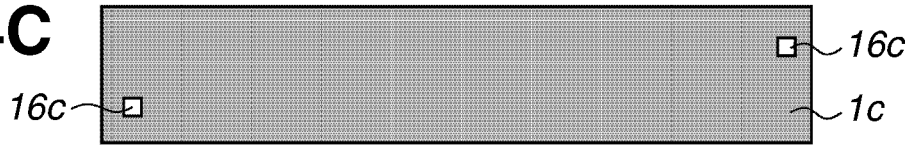
Figure 4D:
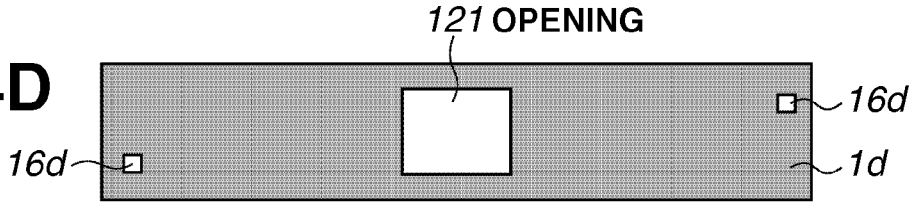
Figure 4E:
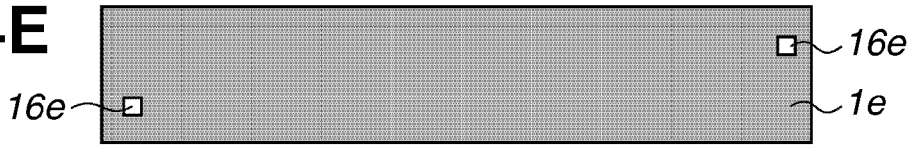
Figure 4F:
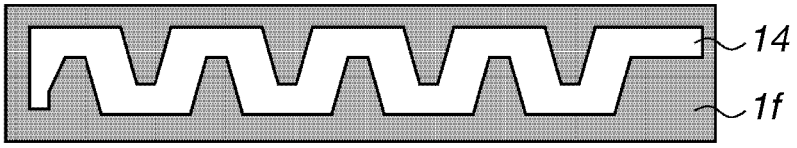
Figure 4G:
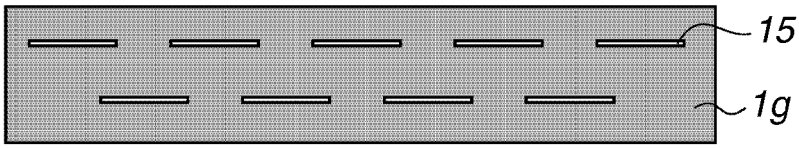

An ink jet head representative for a liquid discharge head configured to discharge liquid will be described as an example. FIG. 1 is an external perspective view of an ink jet head 5 according to the present exemplary embodiment. FIG. 2 is an exploded perspective view of FIG. 1, where the ink jet head 5 includes an ink supply unit 4, a channel member 1, liquid discharge substrates 2 and a flexible wiring substrate 3. FIG. 3A is an external perspective view of the liquid discharge substrate 2, and FIG. 3B is a cross-sectional view taken along the line A-A of FIG. 3A.

The ink jet head 5 according to the present exemplary embodiment has a plurality of the liquid discharge substrates 2 arranged on the channel member 1 in a staggered manner, and entirely has a recording width of about six inches. The liquid discharge substrates 2 are electrically connected to the flexible wiring substrate 3 by wire bonding and the connected parts therebetween are sealed by sealing members 6 for protection.

The liquid discharge substrate 2 is a device configured to discharge ink. As illustrated in FIGS. 3A and 3B, a long-groove shaped ink supply port 222 is formed in a device substrate 22. A plurality of heaters 221 as thermoelectric conversion elements configured to generate energy for discharging ink, and electric wirings (not illustrated) made of aluminum connected to the heaters 221 are formed on a surface of the device substrate 22 by a film forming technique.

Electrodes 223 electrically connected to the flexible wiring substrate 3 are formed at both ends of the device substrate 22 in the longitudinal direction. A discharge port member 21 made of a resin material is formed on the device substrate 22. The discharge port member 21 is provided with discharge ports 211 configured to discharge ink, which are provided corresponding to the heaters 221, and a foaming chamber 213 communicating with the discharge ports 211 by using a photolithography technique. The discharge ports 211 are arranged to form discharge port arrays 212.

As illustrated in FIG. 2, the ink supply unit 4 is provided with an ink inlet port 41 and an ink outlet port 42, both of which are connected to an ink tank provided in an ink jet printer. Ink supplied from the printer main body (not illustrated) passes through a filter (not illustrated) provided inside the ink supply unit 4 and then through an ink inlet port 43 communicating with the channel member 1, and is supplied to an ink inlet port 111 (see FIG. 5) in the channel member 1.

The ink passes through the channels formed inside the channel member 1 described below, is supplied to the ink supply ports 222 in the liquid discharge substrates 2, and is heated and foamed by the heaters 221 in the foaming chambers 213 to be discharged from the discharge ports 211. A power and a signal required for the discharging are supplied from the ink jet printer on which the ink jet head 5 is mounted, through the flexible wiring substrate 3 electrically joined to the liquid discharge substrates 2.

(Channel Member)

The structure of the channel member 1 will be described below. The channel member 1 is formed by sequentially laminating alumina plates 1*a* to 1*g* made of aluminum oxide ($Al_2O_3$) in a thin sheet shape in the order of FIGS. 4A to 4G. FIGS. 4A to 4G are diagrams illustrating the top views of the alumina plates 1*a* to 1*g* of the channel member 1, respectively.

Aluminum oxide is used as the material for the channel member 1 in the present exemplary embodiment, but the channel member 1 is generally made of a ceramic-based material having a low thermal expansion coefficient and an appropriate thermal conductivity. Each of the alumina plates 1*a* to 1*g* has an opening therein, and the alumina plates are laminated to form an ink circulating channel 10 (see FIG. 5) configured to circulate the ink.

The structure of alumina plates 1*a* to 1*g* and the channels constituting the ink circulating channel 10 will be described.

The alumina plate 1*a* as the first layer is provided with the ink inlet port 111 and the ink outlet port 112 near the center of the channel member 1 in the longitudinal direction to be connected to the ink inlet port 43 and the ink outlet port 44 of the ink supply unit 4.

With this arrangement, members connected to a reference member configured to enhance an accuracy of the attachment to the ink jet printer or an ink tank storing ink therein can be arranged at both ends of the ink jet head 5 in the longitudinal direction. The ink inlet port 111 is formed of an opening through which ink flows and a channel configured to connect sub-channels 12 (described below) and the opening.

The alumina plate 1*b* as the second layer is provided with openings as the sub-channels 12. The sub-channels 12 are for communicating, at both ends of the channel member 1 in the longitudinal direction, the ink inlet port 111 and the main channel 14, and the ink outlet port 112 and the main channel 14. The sub-channel 12 configured to connect the ink inlet port 111 and the main channel 14 among the sub-channels 12 is referred to as a first channel.

The alumina plates 1*c* to 1*e* as the third layer to the fifth layer are provided with openings 16*c* to 16*e* to form vertical channels 16 at both ends of each plate in the longitudinal direction, respectively. The alumina plate 1*f* as the sixth layer is provided with the main channel 14 (second channel) in a serpentine shape to be arranged immediately above the liquid discharge substrates 2 arranged in a staggered manner. In the present exemplary embodiment, the sub-channels 12 have the same serpentine shape according to the shape of the main channel 14.

The alumina plate 1*g* as the seventh layer is provided with distribution channels 15 connected to the ink supply ports 222. The liquid discharge substrates 2 are mounted on the mounted face 11 of the channel member 1 (see FIG. 6), that is, the backside of the face on which the openings through which ink flows are provided in such a manner that the discharge ports 211 are arranged on the alumina plate 1*g* in the longitudinal direction.

The sub-channels 12 and the main channel 14 are formed in such a manner that an ink flows in the direction in which the discharge ports 211 are arranged (in the longitudinal direction of the channel member 1 in the present exemplary embodiment). The sub-channels 12 and the main channel 14 are formed in such a manner that the ink flowing directions are opposite between the sub-channels 12 and the main channel 14.

Figure 5:
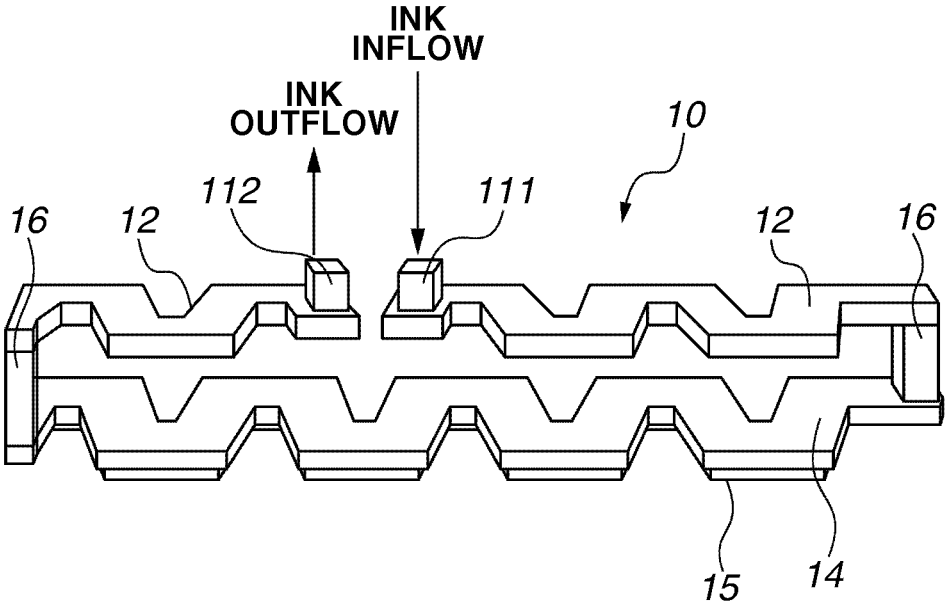
FIG. 5 is a schematic diagram of channels in the channel member according to the first exemplary embodiment.

FIG. 5 is a diagram illustrating the shape of the ink circulating channel 10 formed inside the channel member 1. Ink is flowed from the ink inlet port 111 of the channel member 1 connected to the ink inlet port 43 of the ink supply unit 4 and is introduced into the main channel 14 through the sub-channels 12 and the vertical channels 16. Ink to be discharged is supplied from the main channel 14 to the distribution channels 15 connected to the ink supply ports 222 of the liquid discharge substrates 2.

The ink passing through the main channel 14 without being supplied to the distribution channels 15 passes through the sub-channels 12 to be discharged from the ink outlet port 112 of the channel member 1, and passes inside the ink supply unit 4 to flow into the ink tank of the printer main body. The ink circulating channel 10 is provided to circulate the ink during a recording operation in this way so that an increase in temperature of the ink jet head 5 due to the driving of the heaters 221 can be suppressed.

Figure 6:
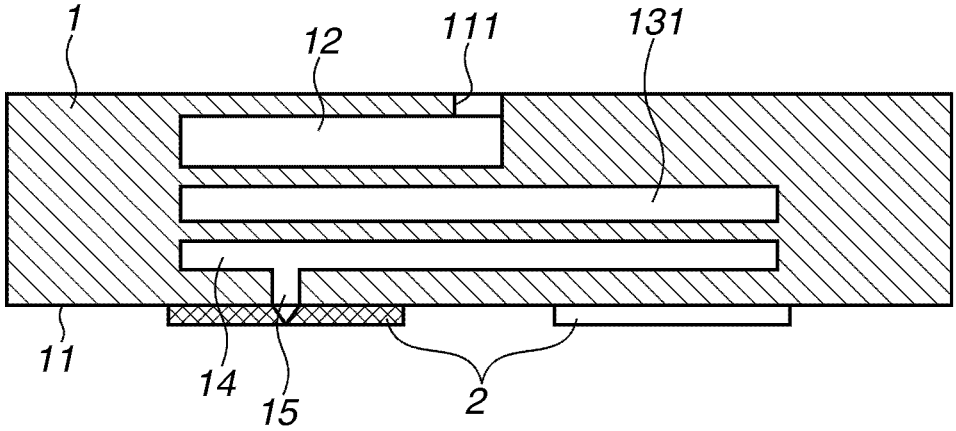
FIG. 6 is a cross-sectional view of a position including a liquid inlet port of the channel member on which the liquid discharge substrates are mounted according to the first exemplary embodiment.

FIG. 6 is a cross-sectional view taken along the shorter direction of the channel member 1 at the position including the ink inlet port 111, in the channel member 1 on which the liquid discharge substrates 2 are mounted.

The alumina plate 1*d* is provided with an opening 121 (see FIG. 4) to be overlapped on the ink inlet port 111 provided in the alumina plate 1*a* in the direction of gravity during use of the channel member 1. Thus, as illustrated in FIG. 6, when the ink jet head 5 is formed, the opening 121 functions as an air layer as a heat insulating portion 131 (low thermal conductivity portion) to be overlapped on the ink inlet port 111 in the direction of gravity below the ink inlet port 111 in the direction of gravity.

There will be described the case in which the heat insulating portion 131 is provided as in the present exemplary embodiment and the case in which the heat insulating portion 131 is not provided.

Figure 7A:
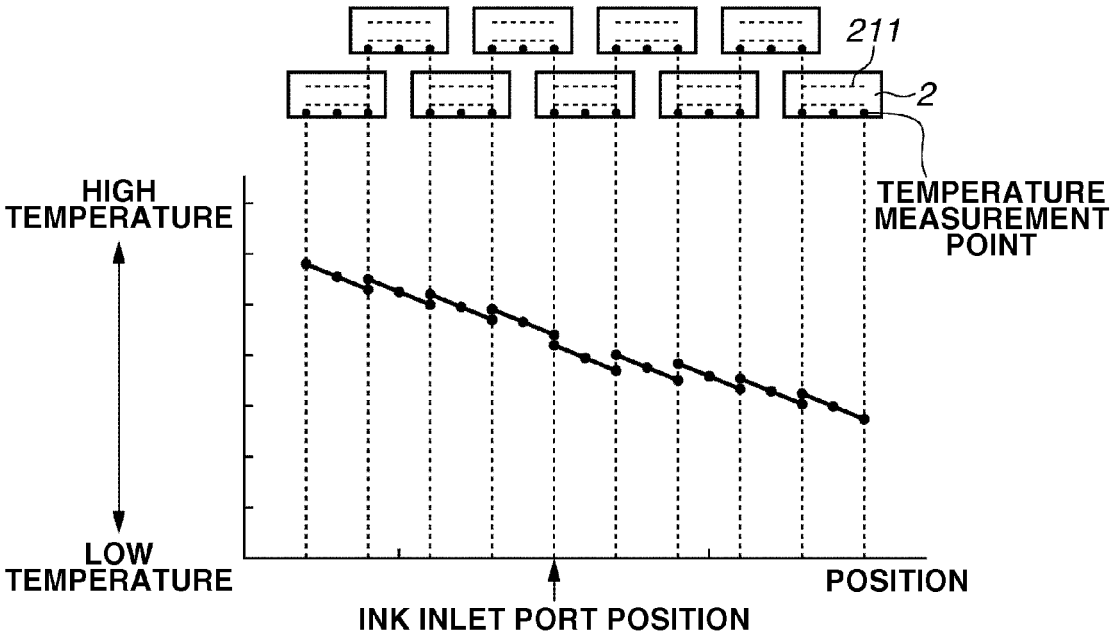
FIG. 7A is a diagram illustrating a temperature distribution in the liquid discharge head according to the first exemplary embodiment.
Figure 7B:
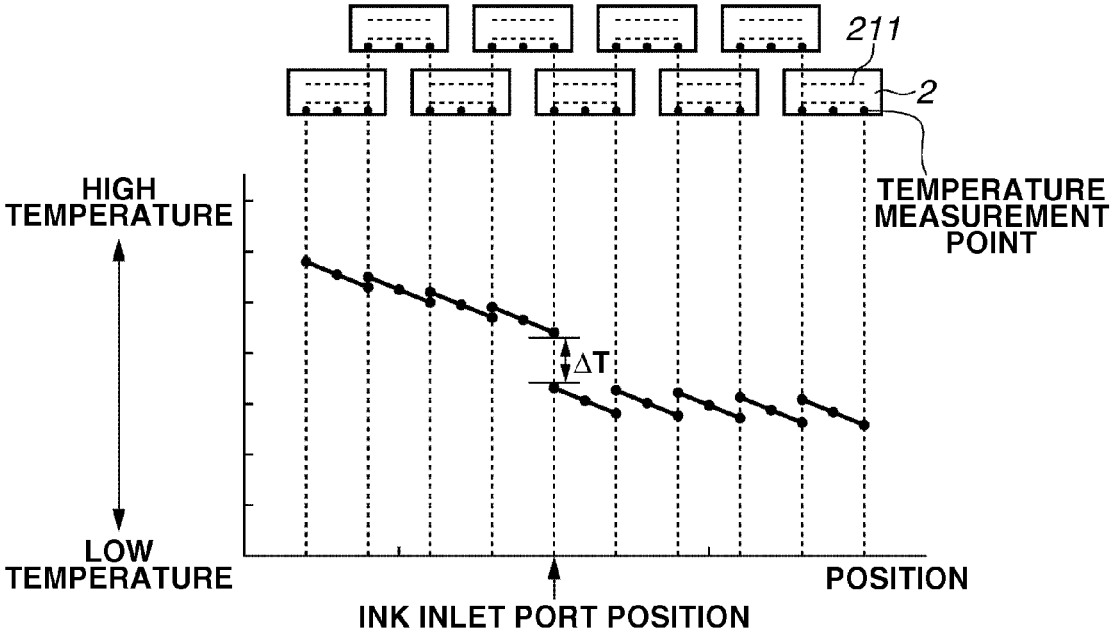
FIG. 7B is a diagram illustrating a comparative example, which corresponds to FIG. 7A when a heat insulating portion is not provided.

FIG. 7A is a diagram illustrating a temperature distribution of the ink jet head 5 according to the present exemplary embodiment. More specifically, a diagram drawn based on the temperatures detected at the three points of both ends and the center of the liquid discharge substrate in the direction in which the discharge ports 211 are arranged for each liquid discharge substrate 2. FIG. 7B is a diagram illustrating, as a comparative example of the present exemplary embodiment, a temperature distribution when the heat insulating portion 131 is not provided.

The ink supplied from the ink inlet port 111 is gradually heated by the heaters 221 of the liquid discharge substrates 2 along with the discharging of the ink, and gradually increased in its temperature particularly in the main channel 14.

On the other hand, the ink flowing through the ink inlet port 111, or the part connecting the ink inlet port 111 and the main channel 14 among the sub-channels 12 is low in temperature, and much in the flowing amount in the channel member 1. Thus, the ink flowing through the ink inlet port 111 or the sub-channels 12 is liable to take heat from its surroundings and can lower the temperature of the liquid discharge substrates 2 provided therebelow.

Therefore, largely-affected parts and small-affected parts of the cooling due to the flowing ink are adjacent to each other in the liquid discharge substrates 2, and there is a possibility of an occurrence of a temperature difference $\Delta T$ (see FIG. 7B) between the adjacent parts in the liquid discharge substrates 2.

If the temperatures of the ink discharged from the adjacent discharge ports 211 are different, a difference occurs in the discharge amount between the adjacent discharge ports 211 and a difference in density easily appears on an image. The liquid discharge substrates 2 provided below the ink inlet port 111 include the liquid discharge substrates 2 not overlapped on the ink inlet port 111 in the direction of gravity and arranged in the vicinity of and below the ink inlet port 111 in the direction of gravity.

The present exemplary embodiment is configured in such a manner that the heat insulating portion 131 is provided to be overlapped on the ink inlet port 111 below the ink inlet port 111 in the direction of gravity and above the main channel 14 in the direction of gravity.

The air layer is provided as the heat insulating portion 131 which is a low thermal conductivity portion having a lower thermal conductivity than the alumina parts of the channel member 1 so that an influence of the cooling by the ink inlet port 111 can be restrained. Thus, a temperature difference between the adjacent parts in the liquid discharge substrates 2 is reduced, thereby reducing a difference in the density of an image. As illustrated in FIG. 7A, it is found that when the heat insulating portion 131 is provided, the temperature difference is reduced between the adjacent parts below the ink inlet port 111.

The present exemplary embodiment is configured such that the ink inlet port 111 is provided near the center of the channel member 1 in the longitudinal direction. However, if the ink inlet port 111 is provided above a position other than the upstream end in the liquid flowing direction of the main channel 14, a similar issue can occur. Thus, the heat insulating portion 131 is provided to be overlapped on the ink inlet port 111 in the direction of gravity as described above, thereby suppressing degradation in image quality.

If the heat generation amount is larger when the number of drives per unit time of the heaters 221 is high, for example, it is assumed that the amount of ink to be circulated is increased for cooling the ink jet head 5. Thus, in such a case, the issue that the liquid discharge substrates 2 provided below the ink inlet port 111 are cooled is likely to apparently occur, and thus the advantage that the heat insulating portion 131 is provided is enhanced.

There is described the example in which a plurality of liquid discharge substrates is arranged to configure the discharge port arrays of the entire head in the present exemplary embodiment, but there may be configured such that all the discharge ports are formed on one liquid discharge substrate.

There will be described below a case in which a plurality of ink supply ports 222 is formed in the liquid discharge substrate 2. The structures of the ink circulating channel 10 and others are similar to those in the first exemplary embodiment, and a description thereof will not be repeated.

Figure 8A:
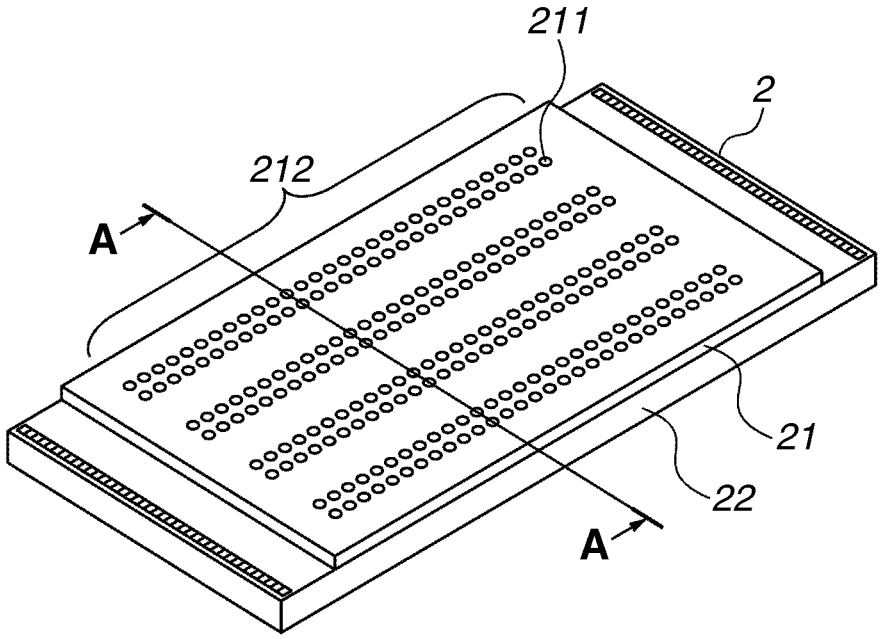
FIGS. 8A and 8B are diagrams illustrating a liquid discharge substrate according to a second exemplary embodiment and a third exemplary embodiment of the present invention.
Figure 8B:
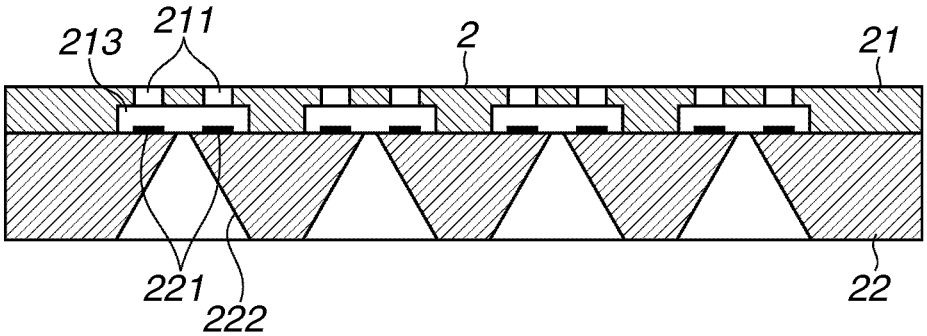
Figure 9A:
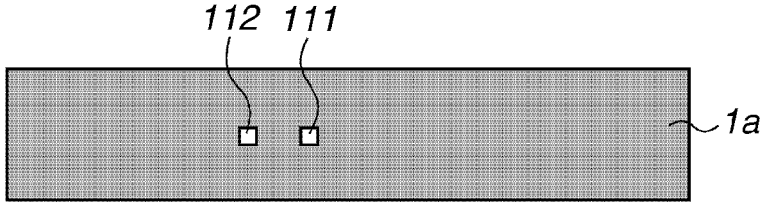
FIGS. 9A to 9G are top views of the respective layers of a channel member according to the second exemplary embodiment.
Figure 9B:
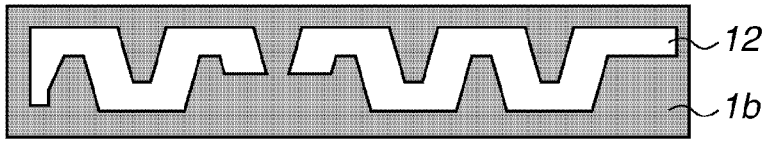
Figure 9C:
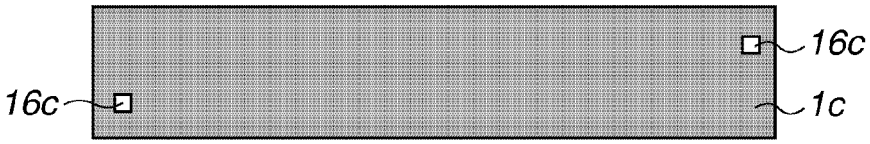
Figure 9D:
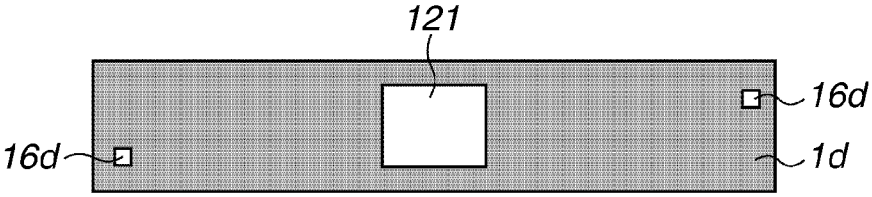
Figure 9E:
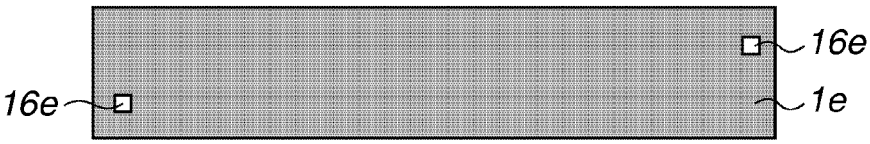
Figure 9F:
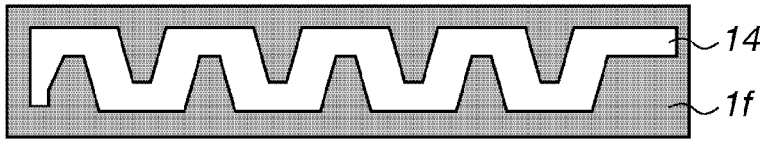
Figure 9G:
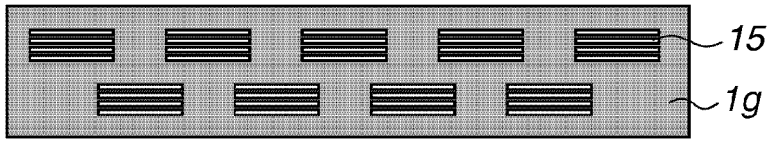

FIG. 8A is an external perspective view illustrating the liquid discharge substrate 2 in which the four ink supply ports 222 are formed, and FIG. 8B is a cross-sectional view taken along the line A-A of FIG. 8A. Two discharge port arrays 212 corresponding to each ink supply port 222 are formed, and eight discharge port arrays are formed in total.

FIGS. 9A to 9G are diagrams illustrating top views of the alumina plates 1*a* to 1*g* configuring the channel member 1 according to the present exemplary embodiment. The alumina plate 1*g* is provided with the distribution channels 15 corresponding to the ink supply ports 222, and the distribution channels 15 are arranged four by four in a staggered manner (see FIG. 9G).

Like the first exemplary embodiment, the opening 121 is formed in the alumina plate 1*d*. Thus, when the inkjet head 5 is formed, the air layer is formed as the heat insulating portion 131 to be overlapped on the ink inlet port 111 in the direction of gravity below the ink inlet port 111 in the direction of gravity.

Thereby, a temperature difference between the adjacent parts in the liquid discharge substrates 2 due to the ink flowed into the ink inlet port 111 can be reduced, thereby reducing a difference in density of an image.

A modification different in the structure of the heat insulating portion from the above-described exemplary embodiment will be described below. The modification described below is also configured such that the heat insulating portion is provided to be overlapped on at least the ink inlet port 111 in the direction of gravity for solving the issue on the temperature difference between the adjacent parts in the liquid discharge substrates 2 due to the ink inlet port 111 or the sub-channels 12.

Figure 10:
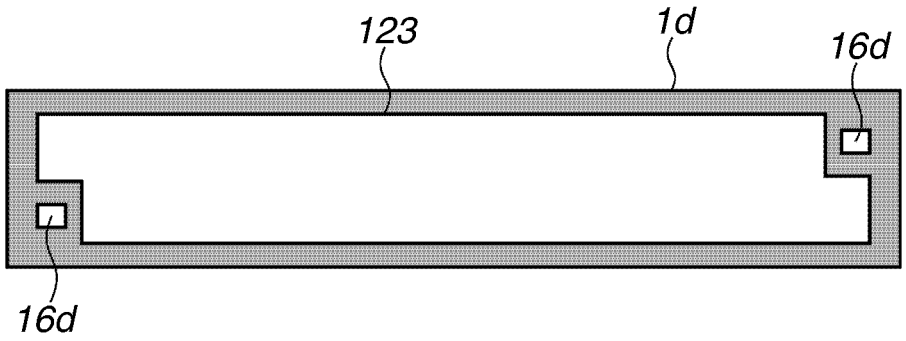
FIG. 10 is a diagram illustrating a modification of a heat insulating portion of the channel member.

FIG. 10 is a diagram illustrating the top view of the alumina plate 1*d*, where an opening 123 is formed on approximately the entire alumina plate 1*d* in the present modification. In this way, the opening 123 is provided on approximately the entire alumina plate 1*d* so that the influence of the heat on the liquid discharge substrates 2 by the ink flowing in the ink inlet port 111 or the sub-channels 12 can be further reduced, which is further preferable.

A plurality of heat insulating portions 133 may be provided in the channel member 1. For example, as in the modification illustrated in FIG. 11A, the alumina plate 1*d* constituting the heat insulating portion 133 may be configured to have an opening 123*a* provided at the center of the alumina plate 1*d* and a plurality of openings 123*b* provided at both ends of the channel chamber 1 in the shorter direction.

Figure 11A:
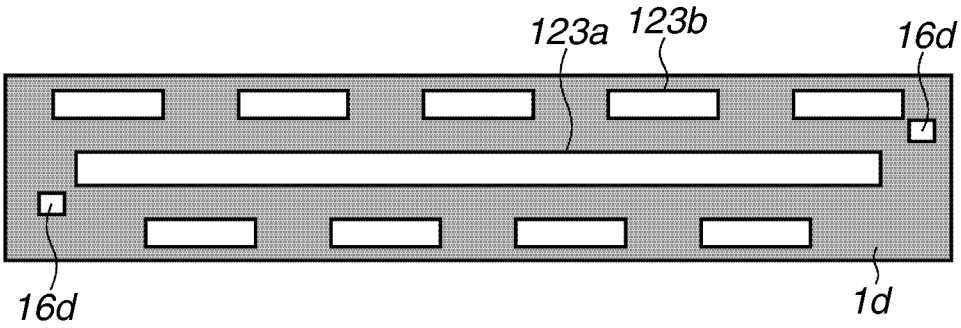
FIGS. 11A and 11B are diagrams illustrating a modification of the heat insulating portion of the channel member.
Figure 11B:
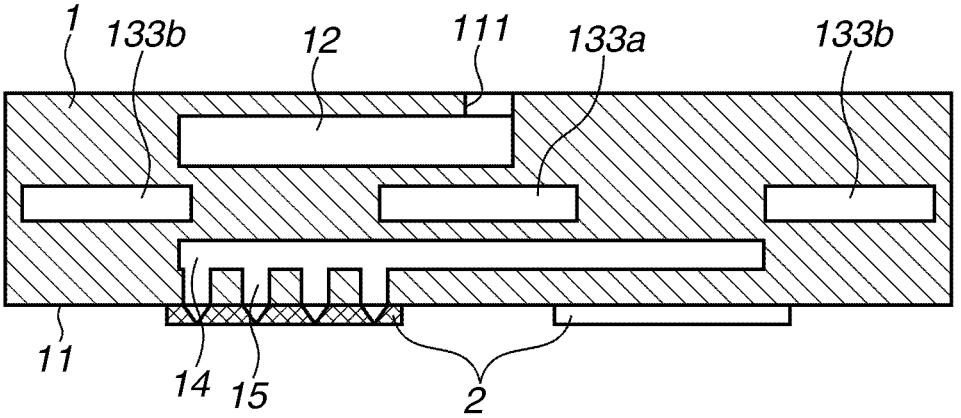
Figure 12A:
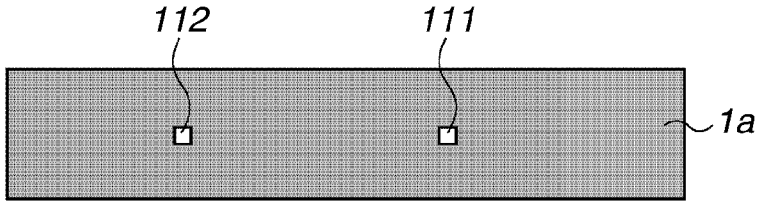
FIGS. 12A to 12G are diagrams illustrating a modification of the heat insulating portion of the channel member.
Figure 12B:
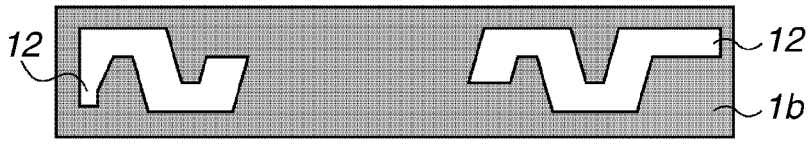
Figure 12C:
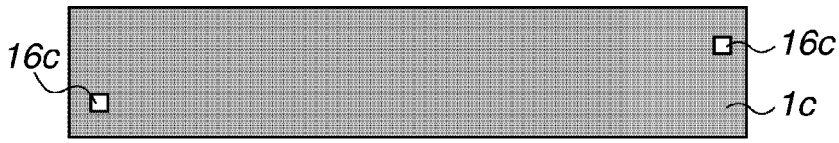
Figure 12D:
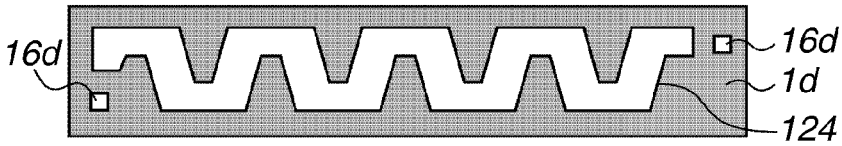
Figure 12E:
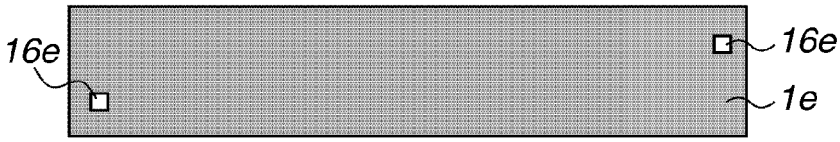
Figure 12F:
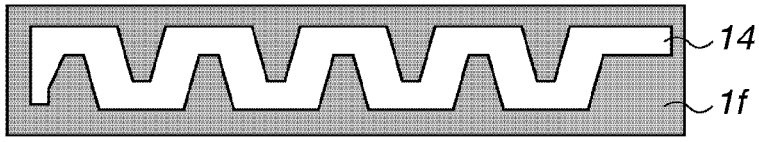
Figure 12G:
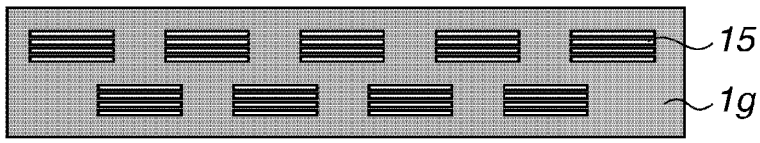

FIG. 11B is a cross-sectional view illustrating the channel member 1 in the shorter direction at the position including the ink inlet port 111 of the channel member 1 having the alumina plate 1*d* illustrated in FIG. 11A. In this case, the heat insulating portion 133*a* is provided at the center of the channel member 1 so that an influence of the cooling on the liquid discharge substrates 2 by the ink inlet port 111 can be reduced.

The heat insulating portions 133*b* are provided in the channel member 1 at both ends in the shorter direction so that an influence of the cooling on the liquid discharge substrates 2 by the sub-channels 12 can be reduced. Since the heat more easily moves via the alumina parts than the ink circulating channel 10 of the channel member 1, the heat insulating portions are provided above the parts where the main channel 14 is not provided.

When the channel member 1 is formed of laminated alumina, the alumina plates 1*a* to 1*g* with openings are laminated and annealed to be the integral channel member 1. At this time, the alumina plates need to be tightly contacted to each other by pressing during the annealing. A pressure can be uniformly applied when the shapes of the alumina plates are similar, and in this case, a sealing failure cannot easily occur due to a lacking pressure.

Therefore, in terms of manufacturing, as in the modification illustrated in FIGS. 12A to 12G, an opening as the heat insulating portion provided in the alumina plate 1*d* is preferably formed to have a similar shape to the main channel 14 or the sub-channels 12, and in the present exemplary embodiment, an opening 124 is formed in a serpentine shape corresponding to the shape of the main channel 14.

As illustrated in the modification of FIGS. 12A to 12G, the ink inlet port 111 and the ink outlet port 112 in the channel member 1 may be arranged away from each other in the longitudinal direction of the channel member 1 according to the positions of the ink inlet port 43 and the ink outlet port 44 in the ink supply unit 4.

The above exemplary embodiment and the modification are configured such that the heat insulating portion 131 is provided to be overlapped on the ink inlet port 111 in the direction of gravity below the ink inlet port 111. However, there may be a case in which a temperature difference becomes larger below the sub-channels 12 than below the ink inlet port 111.

In this case, the heat insulating portion may be provided to be overlapped on the most upstream part in the liquid flowing direction of the sub-channels 12 overlapped on the discharge port arrays 212 in the direction of gravity among the sub-channels 12.

In the present exemplary embodiment, the ink jet head 5 is attached to the ink jet printer so that the mounted face 11 of the channel member 1 is vertical to the direction of gravity. However, the ink jet head 5 may be attached in such manner that the mounted face 11 is tilted relative to the direction of gravity.

In this case, the ink inlet port 111 and the heat insulating portion 131 may be provided to be at least partially overlapped on the mounted face 11 in the vertical direction. Further, the most upstream part of the sub-channel 12 in the liquid flowing direction among the overlapping parts between the sub-channels 12 and the discharge port arrays 212 in the vertical direction to the mounted face 11, and the heat insulating portion 131 may be provided to be at least partially overlapped in the vertical direction to the mounted face 11.

Figure 13:
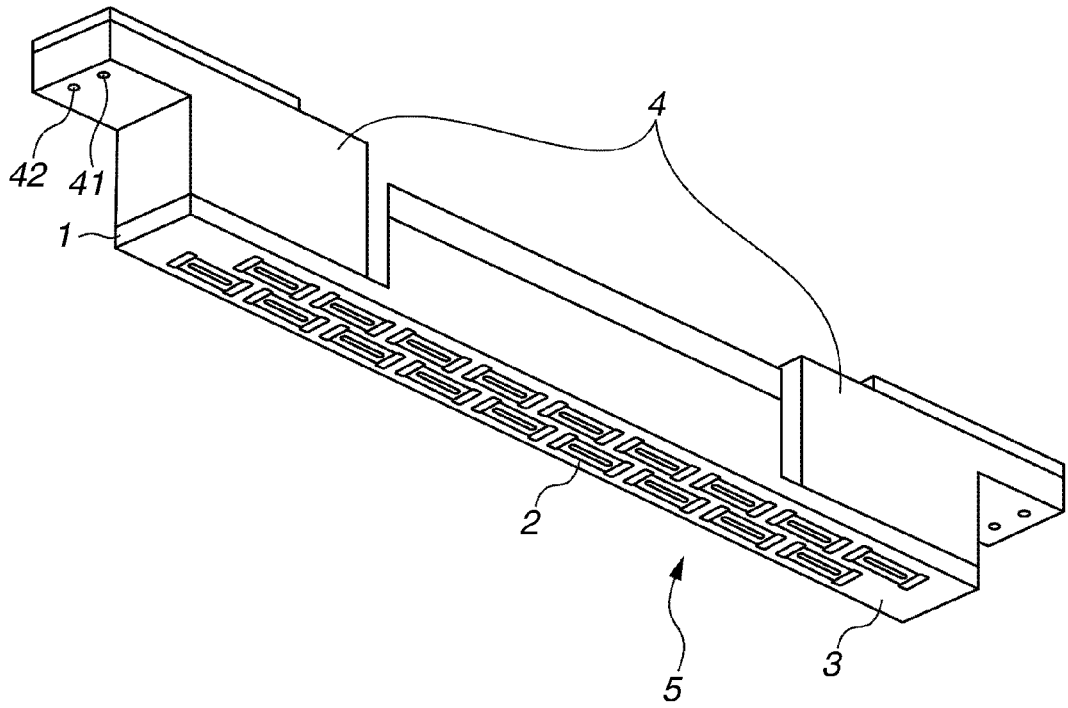
FIG. 13 is an external perspective view illustrating a liquid discharge head according to the third exemplary embodiment of the present invention.

A third exemplary embodiment in which an ink jet head having a longer recording width is configured will be described below. FIG. 13 is an external perspective view of the ink jet head 5 according to the present exemplary embodiment. In the present exemplary embodiment, 18 liquid discharge substrates are arranged in a staggered manner to form the ink jet head 5 having the recording width of about 12 inches.

In this way, when the recording width is large, ink is circulated in one main channel 14 like the above exemplary embodiments, so that the ink is increased in its temperature due to the heat radiated from the liquid discharge substrates 2. As a result, a temperature difference becomes larger between the downstream liquid discharge substrates 2 and the upstream liquid discharge substrates 2 during the recording operation. Thus, the ink circulating channel 10 is provided to be divided into two channels in the longitudinal direction of the channel member 1, thereby suppressing the increase in temperature of the ink to approximately half.

Figure 14A:
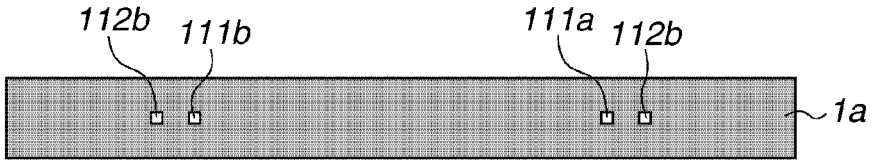
FIGS. 14A to 14G are top views of the respective layers of the channel member according to the third exemplary embodiment of the present invention.
Figure 14B:
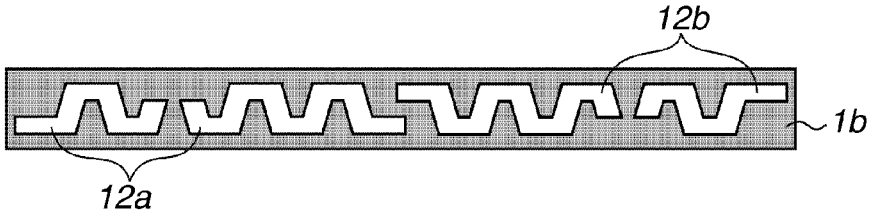
Figure 14C:
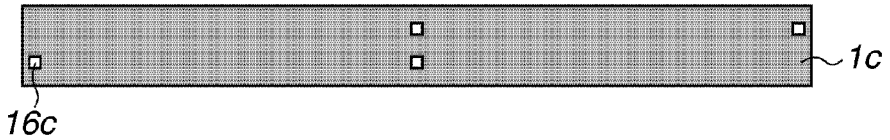
Figure 14D:
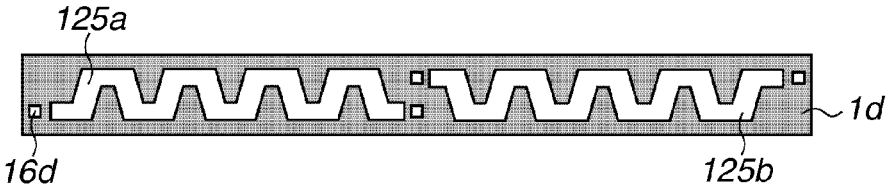
Figure 14E:
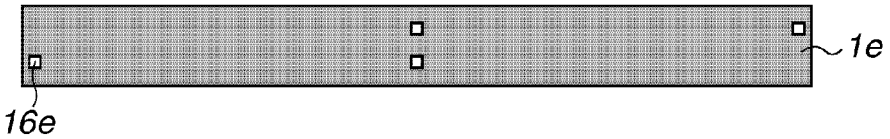
Figure 14F:
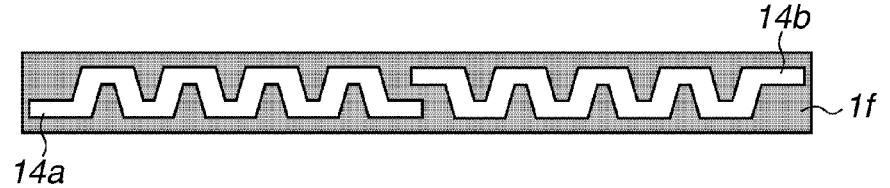
Figure 14G:
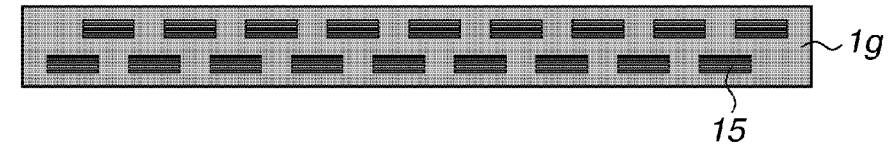
Figure 15:
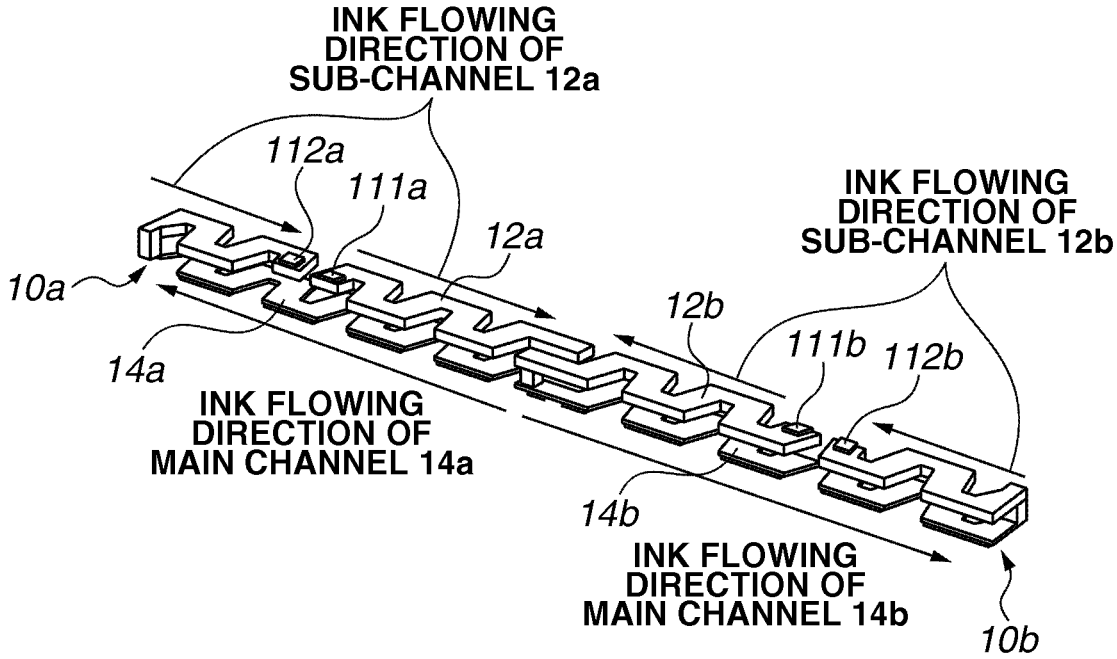
FIG. 15 is a diagram illustrating channels in the channel member and liquid flowing directions during a recording operation according to the third exemplary embodiment.
Figure 16A:
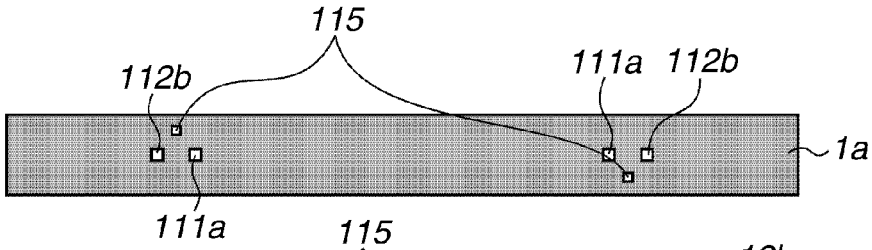
FIGS. 16A to 16G are diagrams illustrating a structure in which communication ports communicating with the heat insulating portions are provided in the channel member.
Figure 16B:
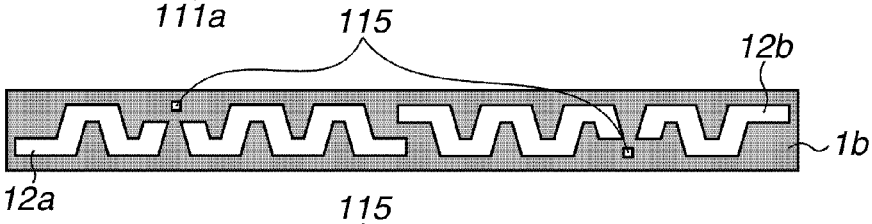
Figure 16C:
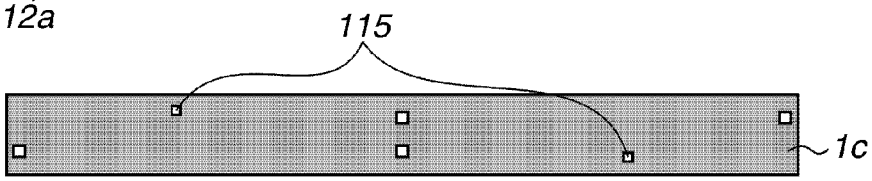
Figure 16D:
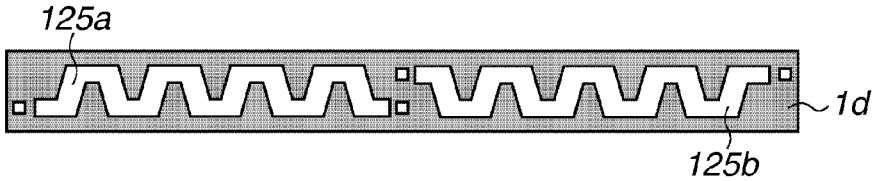
Figure 16E:
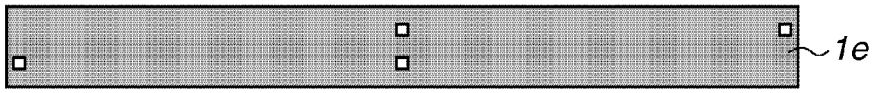
Figure 16F:
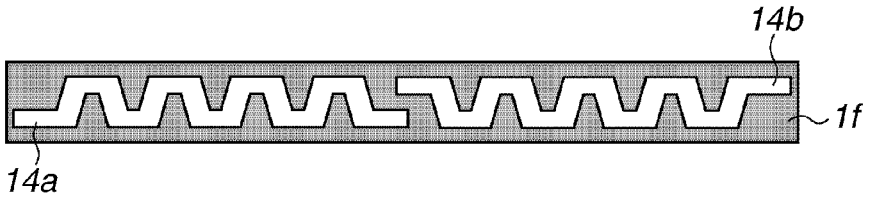
Figure 16G:
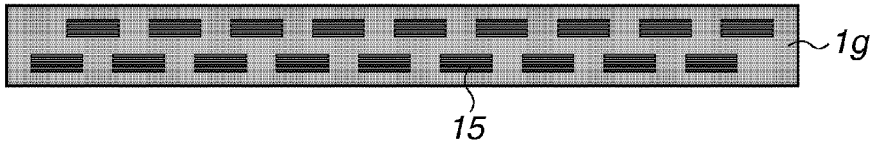

FIGS. 14A to 14G are diagrams illustrating top views of the alumina plates 1*a* to 1*g* of the channel member 1 according to the present exemplary embodiment, and FIG. 15 is a diagram illustrating ink circulating channels 10*a* and 10*b* inside the channel member 1 which is formed of the laminated alumina plates.

The two ink circulating channels 10*a* and 10*b* are provided to be independent from each other within the channel member 1. Main channels 14*a* and 14*b* are provided as the main channels 14 of the ink circulating channels 10*a* and 10*b*, and sub-channels 12*a* and 12*b* are provided as the sub-channels 12 of the ink circulating channels 10*a* and 10*b*.

Two ink supply units 4 are provided to supply an ink to the two ink circulating channels 10*a* and 10*b*, respectively. FIG. 14D illustrates a structure in which two openings 125*a* and 125*b* are provided as the heat insulating portions for securing the area for the vertical channels 16. The two divided heat insulating portions may not be provided and the opening 125 as the heat insulating portion may be formed over the two main channels.

When the recording operation is performed while ink is being circulated along the main channels 14, the ink is increased in its temperature due to the heat radiation from the liquid discharge substrates 2. As a result, a temperature difference of the ink is large between the heads of the ink flows in the main channels 14 and the ends of the ink flows of the main channels 14.

When the ink flowing directions during the recording operation are set so that the head of one main channel 14 and the end of the other main channel 14 are adjacent to each other, a temperature difference is large between the adjacent liquid discharge substrates 2 corresponding to the two adjacent main channels 14*a* and 14*b*. A difference in the discharging amount occurs between the adjacent discharge ports 211, which can degrade the image quality.

Thus, it is desirable that the ink flowing directions are set so that the two main channels 14 are adjacent to each other at the heads or the ends. Further, when the usage frequency of each liquid discharge substrate 2 is different, a difference may occur in the degree of increase in ink temperature, and thus it is desirable that the ink flowing directions are set so that the heads of the main channels 14 are adjacent to each other (see FIG. 15).

Since the heads of the main channels 14 are insusceptible to the heat radiation from the liquid discharge substrates 2, the heads of the two main channels 14 are configured to be adjacent to each other, thereby reducing the temperature difference between the adjacent liquid discharge substrates 2 corresponding to the two adjacent main channels 14.

The heat insulating portion in which air layer is sealed is exemplified in the above exemplary embodiments, but the alumina plates 1*a* to 1*c* may be provided with communication ports 115 configured to communicate the heat insulating portion with the atmosphere as illustrated in FIG. 16.

In the heat insulating portion in which a gas layer is sealed, when the channel member 1 is formed of the laminated alumina plates, there may be a possibility that the channel member 1 can be deformed or the alumina plates can be released from each other due to the expansion of the gas inside the heat insulating portion during the calcination process. The communication ports 115 configured to communicate the heat insulating portion with the atmosphere are provided, thereby reducing the above-described possibility.

When the temperature of the ink jet head 5 is higher than that of the surroundings, the effect of the cooling of the ink jet head 5 can be expected due to the exchange of the air inside the heat insulating portion and the surrounding air via the communication ports 115.

The example in which the air layer functions as the heat insulating portion is described in the above exemplary embodiments, however, the heat insulating portion may only have the thermal conductivity lower than the thermal conductivity of the wall forming the ink circulating channel 10 in the channel member 1, and may be filled with a material such as resin.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-112365 filed May 14, 2010, which is hereby incorporated by reference herein in its entirety.

What is claimed is:

1. A liquid discharge head comprising:

a plurality of liquid discharge substrates having a discharge port array in which a plurality of discharge ports configured to discharge liquid are arranged, and a plurality of thermoelectric conversion elements configured to generate energy for discharging liquid from the plurality of discharge ports; and a channel member having a mounted face on which the liquid discharge substrates are mounted, channels configured to supply liquid to the plurality of discharge ports, and a low thermal conductivity portion having a lower thermal conductivity than that of a wall forming the channel, wherein the channels include an opening configured to flow liquid, which is provided at a part except for both ends of the discharge port array in an arrangement direction in which the plurality of discharge ports is arranged on the backside of the mounted face, a first channel configured to pass the liquid flowed from the opening and to pass liquid along the arrangement direction, and a second channel configured to pass the liquid flowing through the first channel in a direction opposite to the liquid flowing direction in the first channel, wherein the opening, the first channel, the low thermal conductivity portion, and the second channel are provided in this order in a direction vertical to the mounted face, wherein the opening and the low thermal conductivity portion are provided to be at least partially overlapped one above the other in the vertical direction to the mounted face, and wherein the opening is provided not to be overlapped on the liquid discharge substrates in the vertical direction.

2. A liquid discharge head comprising:

a plurality of liquid discharge substrates having a discharge port array in which a plurality of discharge ports configured to discharge liquid is arranged, and a plurality of thermoelectric conversion elements configured to generate energy for discharging liquid from the plurality of discharge ports; and a channel member having a mounted face on which the liquid discharge substrates are mounted, channels configured to supply liquid to the plurality of discharge ports, and a low thermal conductivity portion having a lower thermal conductivity than that of a wall forming the channel, wherein the channels include an opening configured to flow a liquid, a first channel configured to pass the liquid flowed from the opening and to pass liquid along an arrangement direction in which the plurality of discharge ports is arranged, and a second channel configured to pass the liquid flowing in the first channel in a direction opposite to the liquid flowing direction in the first channel, wherein the first channel, the low thermal conductivity portion, and the second channel are provided in this order in a direction vertical to the mounted face, wherein the first channel has a portion overlapped on an area except for both ends of the discharge port array in the vertical direction to the mounted face, and the most upstream part in the flowing direction among the overlapping portion and the low thermal conductivity portion are provided to be at least partially overlapped one above the other in the vertical direction to the mounted face, and wherein the most upstream part is provided not to be overlapped on the liquid discharge substrates in the vertical direction.

3. The liquid discharge head according to claim 1, wherein the low thermal conductivity portion and the second channel are at least partially overlapped one above the other in the vertical direction.

4. The liquid discharge head according to claim 1, wherein the liquid discharge substrates are arranged in a staggered manner in the arrangement direction.

5. The liquid discharge head according to claim 1, wherein the low thermal conductivity portion is a gas layer.

6. The liquid discharge head according to claim 5, wherein the channel member is provided with a communication port configured to communicate the low thermal conductivity portion to the atmosphere.

7. The liquid discharge head according to claim 1, wherein the cross-sectional shapes of the first channel, the second channel, and the low thermal conductivity portion are the same in the direction along the mounted face.

8. The liquid discharge head according to claim 1, wherein the low thermal conductivity portion is provided approximately on the entire channel member in the direction along the mounted face.

9. The liquid discharge head according to claim 1, wherein the channel member is formed of a plurality of laminated plates formed of aluminum oxide material.

* * * * *